US005439394A

United States Patent [19]

Ikeda

[11] Patent Number: 5,439,394

[45] Date of Patent: Aug. 8, 1995

[54] ELECTRIC CONNECTOR WITH A COAXIAL CONNECTOR

[75] Inventor: Kazuhiko Ikeda, Tokyo, Japan

[73] Assignee: Hirose Electric Co., Ltd., Tokyo, Japan

[21] Appl. No.: 214,552

[22] Filed: Mar. 18, 1994

[30] Foreign Application Priority Data

Apr. 23, 1993 [JP] Japan ..... 5-026543 U

[51] Int. Cl.[6] ..... H01R 17/04

[52] U.S. Cl. ..... 439/675; 439/578

[58] Field of Search ..... 439/578–585, 439/696, 701, 660, 607, 562, 564, 569, 573, 675

[56] References Cited

U.S. PATENT DOCUMENTS

| | | | |
|---|---|---|---|
| 5,125,864 | 6/1992 | Bassler et al. | 439/607 |
| 5,288,246 | 2/1994 | Whiteman, Jr. et al. | 439/571 |
| 5,314,357 | 5/1994 | Weidler | 439/701 |

*Primary Examiner*—David L. Pirlot
*Attorney, Agent, or Firm*—Kanesaka & Takeuchi

[57] ABSTRACT

An electrical connector includes a housing (2); at least one coaxial connector (3) disposed in the housing; a fitting portion (14B) provided in the coaxial connector for receiving a mating connector; and a pair of cut-outs (16) formed on upper and lower sides of the fitting portion to thereby minimizing a height of the housing.

2 Claims, 5 Drawing Sheets

ELECTRIC CONNECTOR WITH A COAXIAL CONNECTOR

BACKGROUND OF THE INVENTION

1. Field of the Invention

The present invention relates to electrical connectors having at least one coaxial cable.

2. Description of the Related Art

Japanese UM patent application Kokai No. 4-123089 discloses a composite electrical connector of this type. The composite electrical connector has a number of coaxial connectors arranged widthwise in a housing with their axis parallel to each other.

There is another composite electrical connector which includes, in addition to the coaxial connectors, a second connector having a number of contact elements arranged widthwise in a housing. The thickness or height of the second connector is usually smaller than the outside diameter of the coaxial connector.

Consequently, the height of the above housing is substantially determined by the outside diameter of a cylindrical portion of the coaxial connector. More specifically, the thickness of the above composite electrical connectors is no less than the sum of the outside diameter of the cylindrical portion of the coaxial connector and the thickness of a tubular wall formed on the front portion of the housing for support of the cylindrical portion and connection with the mating connector.

The large height of the composite electrical connectors prevent circuit boards from being arranged in electronic equipment with small distances between the boards, thus preventing miniaturization of the electronic equipment.

SUMMARY OF THE INVENTION

Accordingly, it is an object of the invention to provide a low profile electric connector having a coaxial connector.

According to an aspect of the invention there is provided an electrical connector which includes a housing; at least one coaxial connector disposed in the housing; a fitting portion provided in the coaxial connector for receiving a mating connector; and a pair of cut-outs formed on upper and lower sides of the fitting portion to thereby minimizing a height of the housing.

According to another aspect of the invention there is provided an electrical connector which further includes support shoulders on the housing to support the sides of the cut-outs to thereby minimizing deformation of the fitting portion upon plugging in and out operations.

Since the fitting portion of the coaxial connector, which is the thickest part in the coaxial connector, is provided with a pair of cut-outs on the upper and lower sides, it is possible to minimize the thickness of the housing by that much.

Since the mating coaxial connector is shielded, the central conductor of the coaxial connector fitted in the mating connector is shielded despite the present of the cutouts on the fitting portion.

The support shoulders for support the sides of the cut-outs minimize the decrease in strength by the present of the cut-outs.

The above and other objects, features, and advantages of the invention will be more apparent from the following description when taken in conjunction with the accompanying drawings.

DESCRIPTION OF THE PREFERRED EMBODIMENT

Figure 1:
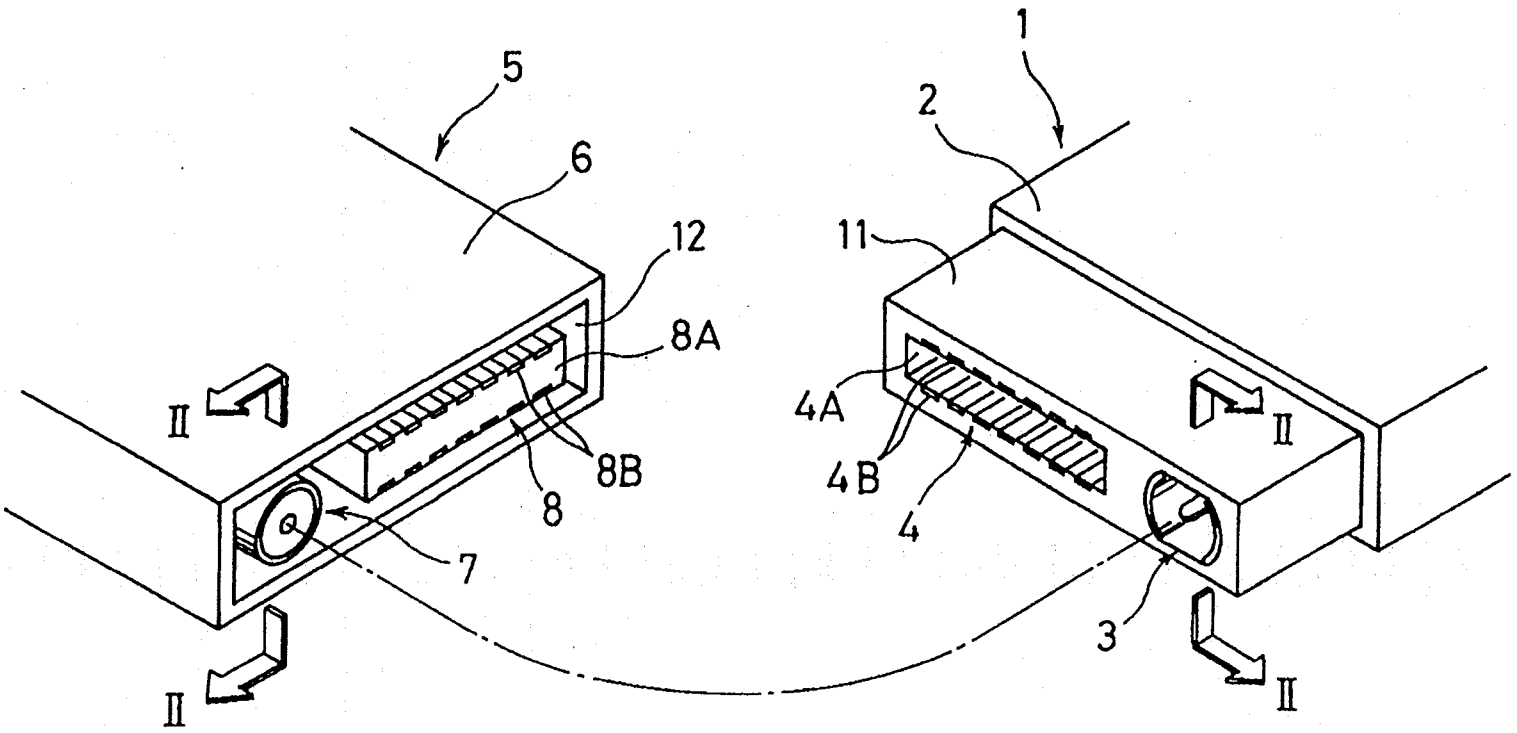
FIG. 1 is a perspective view of an electrical connector according to an embodiment of the invention.

In FIG. 1, a composite electrical connector 1 includes in a housing 2 two types of connectors; a coaxial plug 3 and a female connector 4 having contact elements 4B arranged in lines. A mating composite electrical connector 5 includes in a housing 6 a coaxial receptacle 7 for connection with the coaxial plug 3 and a male connector 8 for connection with the female connector 4.

As FIG. 1 shows, the female and male connectors 4 and 8 are of the conventional type. The contact elements 4B of the female connector 4 are arranged within a rectangular cavity 4A of the housing 2. The corresponding contact elements 8B are arranged on upper and lower surfaces of a rectangular column 8A which is fitted into the rectangular cavity 4A. The female and male connectors 4 and 8 may be replaced with the coaxial plug and receptacle 3 and 7, respectively.

Figure 2:
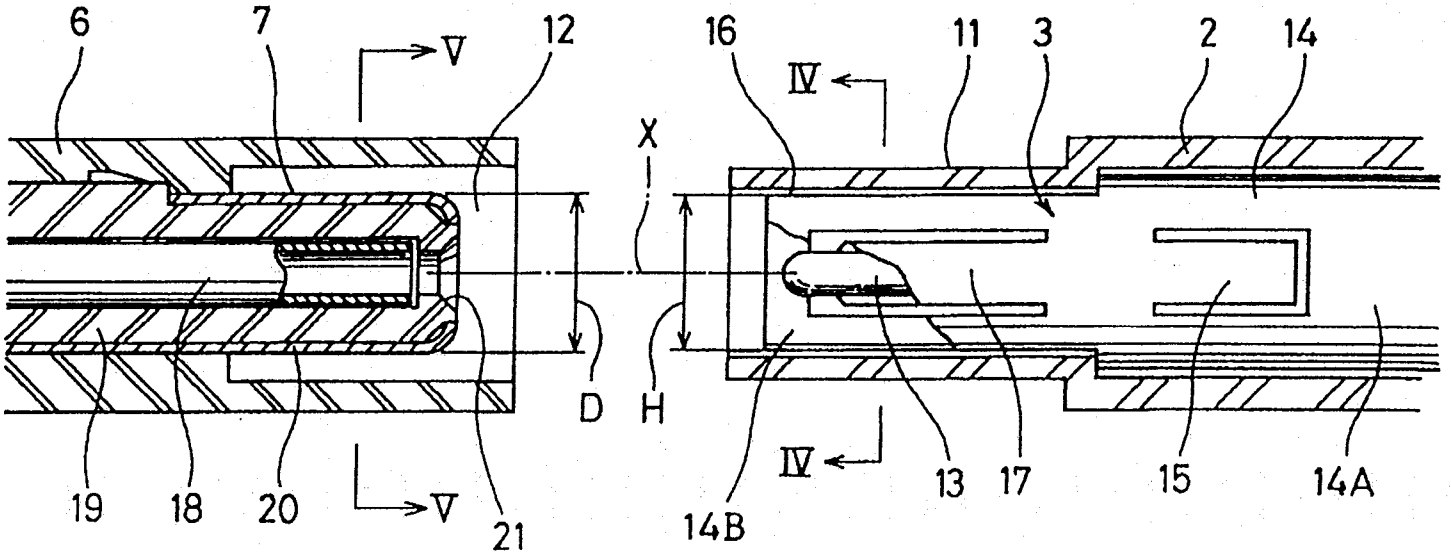
FIG. 2 is a sectional view taken along line II—II of FIG. 1.

In FIG. 2, the coaxial plug and receptacle 3 and 7 are disposed within the housing 2 and 6, respectively. A stepped portion 11 is formed on the outside of the housing 1 to be fitted into a front recess 12 of the housing 6.

Figure 3:
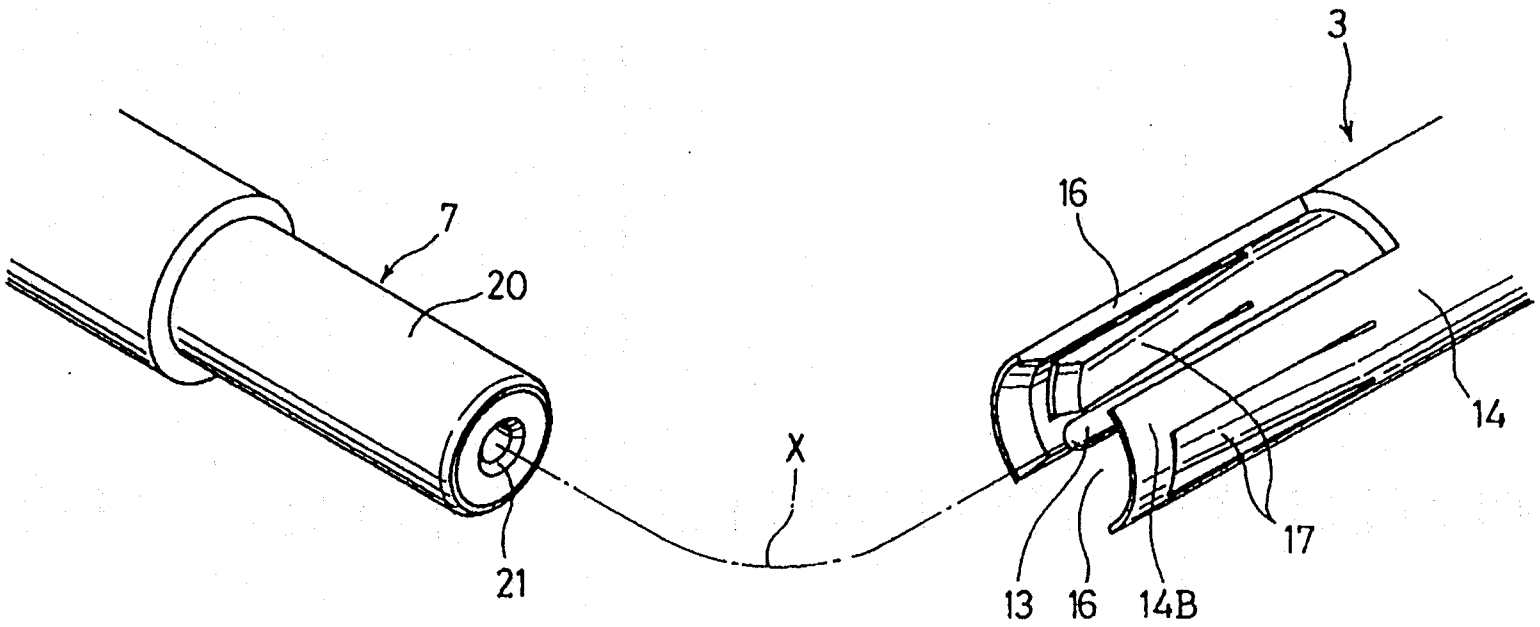
FIG. 3 is a perspective view of a coaxial connector of the electrical connector.

In FIGS. 2 and 3, the plug 3 includes a pin-shaped male contact (central conductor) 13 disposed on a central axis X and a substantially tubular outer conductive shell 14 which supports the male contact 13 through a dielectric member (not shown). The conductive shell 14 has a rear supported portion 14A and a front fitting portion 14B. The supported portion 14A is made in the form of a tube. An engaging piece 15 is formed by making a C-shaped cut on a side of the supported portion 14A so that a free end thereof project outwardly.

Figure 4:
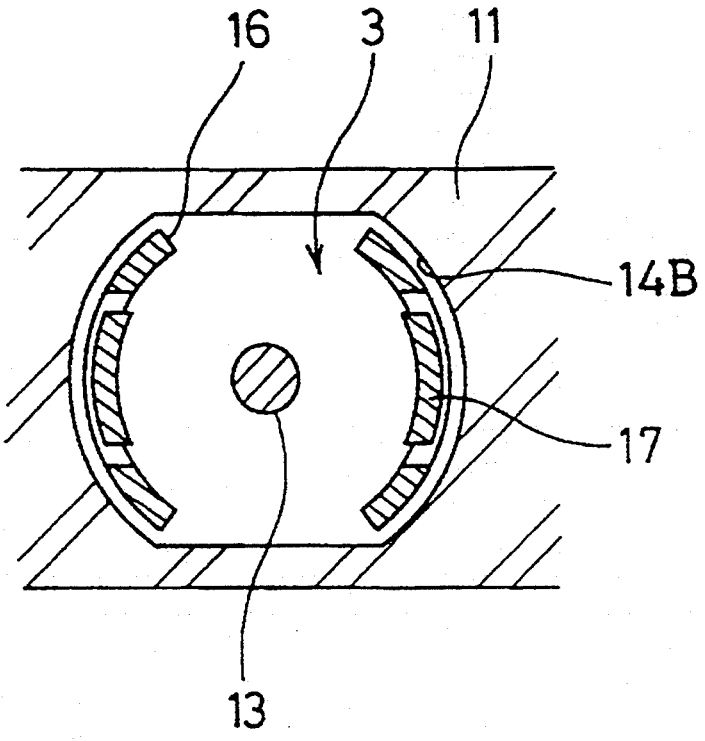
FIG. 4 is a sectional view taken along line IV—IV of FIG. 2.

In FIGS. 3 and 4, a pair of cut-outs 16 are formed on upper and lower sides of the fitting portion 14B of the conductive shell 14. The amount of cut on the cut-outs 16 is such that the distance H between the cut-outs 16 is substantially equal to the outside diameter D of the receptacle 7 or the inner diameter of the fitting portion 14B. A pair of spring contact pieces 17 are formed by making C-shaped cuts on sides of the fitting portion 14B such that their free ends project somewhat inwardly.

Thus, the thickness of the stepped portion of the housing 2 is less than that of the conventional one by the amount of cut on the cut-outs 16.

When the conductive shell 14 is fitted into the housing 2, the supported portion 14A is supported by the housing 2, with the engaging pieces 15 engaging engaging shoulders (not shown) of the housing 2 to thereby prevent falling off of the conductive shell 14.

Figure 5:
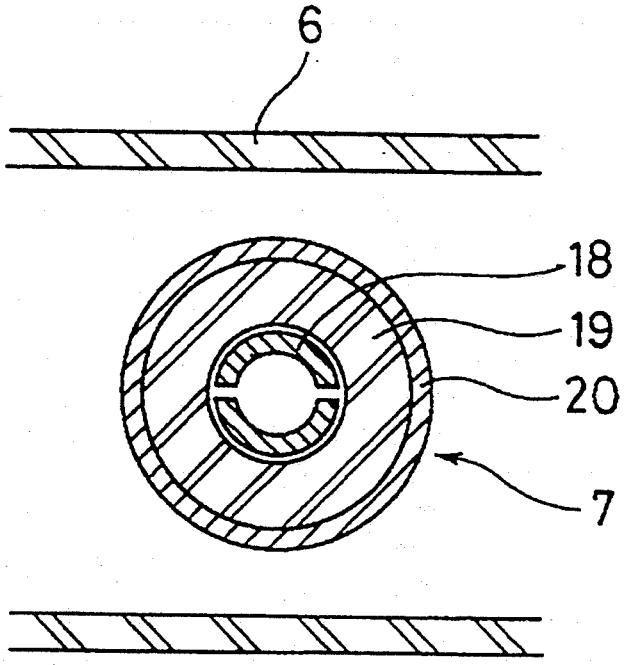
FIG. 5 is a sectional view taken along line V—V of FIG. 2.

In FIGS. 1–3, the receptacle 7 of a mating coaxial connector has the same structure as the conventional one within the housing 6. The receptacle 7 includes a slitted cylindrical female contact element 18 disposed on the central axis for receiving the male contact element 13 and an outer conductive shell 20 for supporting the female contact element 18 via a dielectric member 19 (as best shown in FIG. 5). The front portion of the receptacle 7 projects into the front recess 12 of the housing 6. The outside diameter D of the conductive shell 20 is adapted to fitted into the fitting portion 14B of the plug 14. The front end 21 of the dielectric member 19 is tapered to facilitate insertion of the male contact element 13 into the female contact element 18.

The female connector 4 and the coaxial connector plug 3 are connected to the male connector 8 and the receptacle 7, respectively, by fitting the stepped portion 11 of the composite electric connector 1 into the front recess 12 of the mating connector 5. Although the conductive shell 14B of the plug 3 has the cut-outs 16, the male contact member 13 of the plug 3 is shielded because the conductive shell 20 of the receptacle 7 has no cut-outs.

In this way, according to the invention it is possible to reduce the thickness of the stepped portion 11 of a housing by forming cut-outs 16 on the conductive shell 14B. It is also possible to reduce the thickness of a mating composite electrical connector accordingly.

Figure 6:
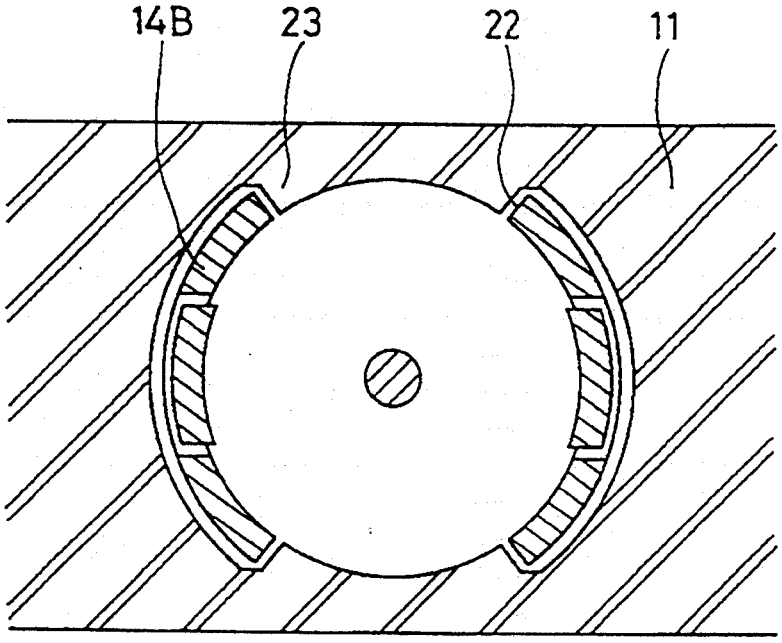
FIG. 6 is a sectional view of an electrical connector having a coaxial connector another embodiment of the invention.

In the above embodiment, however, the cut-outs can present a problem because they reduce the strength of the conductive shell upon plugging in and out. In FIG. 6, support shoulders 23 are formed on the housing 2 to support the sides 22 of cut-outs to thereby prevent the conductive shell 14B from being deformed upon plugging in and out of a mating connector.

Although has been described on the composite electrical connectors, the invention is applicable to other types of electrical connectors such as one having a single coaxial connector.

According to the invention, it is possible to minimize the thickness of a housing without impairing the shielding effects by providing cut-outs on the upper and lower sides of a conductive shell of the coaxial connector, thereby providing a low profile electric connector, which in turn making it possible to mount circuit boards with high density and miniaturized equipment possible.

I claim:

1. An electrical connector comprising:

a housing;

at least one coaxial connector disposed in said housing;

a conductive shell with a fitting portion provided in said coaxial connector for receiving a mating connector; and at least one cut-out formed on at least one of upper and lower sides of said fitting portion thereby minimizing a height of said housing.

2. The electrical connector of claim 1, which further comprises support shoulders formed on said housing for supporting sides of said cut-out thereby minimizing deformation of said conductive shell upon plugging in and out operations.

* * * * *